US009447672B2

(12) United States Patent
Arrell, Jr. et al.

(10) Patent No.: US 9,447,672 B2
(45) Date of Patent: Sep. 20, 2016

(54) METHOD AND APPARATUS FOR BALLISTIC TAILORING OF PROPELLANT STRUCTURES AND OPERATION THEREOF FOR DOWNHOLE STIMULATION

(71) Applicant: Orbital ATK, Inc., Dulles, VA (US)

(72) Inventors: John A. Arrell, Jr., Lincoln University, PA (US); Steven E. Moore, Elkton, MD (US)

(73) Assignee: Orbital ATK, Inc., Plymouth, MN (US)

( * ) Notice: Subject to any disclaimer, the term of this patent is extended or adjusted under 35 U.S.C. 154(b) by 418 days.

(21) Appl. No.: 13/781,217

(22) Filed: Feb. 28, 2013

(65) Prior Publication Data

US 2014/0238678 A1 Aug. 28, 2014

(51) Int. Cl.

| | |
|---|---|
| ***E21B 43/263*** | (2006.01) |
| ***C06B 45/00*** | (2006.01) |
| ***F42B 1/00*** | (2006.01) |
| ***F42B 1/04*** | (2006.01) |
| ***E21B 43/247*** | (2006.01) |
| ***C06B 45/10*** | (2006.01) |
| *C06B 33/00* | (2006.01) |
| *C06B 25/00* | (2006.01) |
| *C06B 29/00* | (2006.01) |
| *C06B 31/00* | (2006.01) |

(52) U.S. Cl.

CPC ..... *E21B 43/263* (2013.01); *C06B 45/00* (2013.01); *C06B 45/10* (2013.01); *C06B 45/105* (2013.01); *E21B 43/247* (2013.01); *F42B 1/00* (2013.01); *F42B 1/04* (2013.01); *C06B 25/00* (2013.01); *C06B 29/00* (2013.01); *C06B 31/00* (2013.01); *C06B 33/00* (2013.01)

(58) Field of Classification Search

CPC ..... E21B 43/263; C06B 45/00; C06B 33/00; C06B 25/00; C06B 29/00; C06B 31/00

See application file for complete search history.

(56) References Cited

U.S. PATENT DOCUMENTS

| | | | | |
|---|---|---|---|---|
| 2,921,519 | A * | 1/1960 | Martin | 102/317 |
| 3,090,436 | A | 5/1963 | Briggs, Jr. | |
| 3,602,304 | A | 8/1971 | Mallinger et al. | |
| 3,677,010 | A * | 7/1972 | Fink et al. | 60/220 |
| 4,391,337 | A | 7/1983 | Ford et al. | |
| 4,633,951 | A | 1/1987 | Hill et al. | |
| 4,729,317 | A * | 3/1988 | Burdette | C06B 45/12 102/287 |
| 4,798,244 | A * | 1/1989 | Trost | 166/250.01 |
| 4,823,875 | A * | 4/1989 | Hill | 166/280.1 |

(Continued)

OTHER PUBLICATIONS

Thakre et al., "Solid Propellants," Rocket Propulsion, vol. 2, Encyclopedia of Aerospace Engineering, John Wiley & Sons, Ltd., 2010, pp. 1-10.

(Continued)

*Primary Examiner* — Robert E Fuller
(74) *Attorney, Agent, or Firm* — TraskBritt

(57) ABSTRACT

Propellant structures and stimulation tools incorporating propellant structures may comprise composite propellant structures including two or more regions of propellant having different compositions, different grain structures, or both. An axially extending initiation bore containing an initiation element may extend through a center of the propellant structure, or may be laterally offset from the center. An offset initiation bore may be employed with a composite grain structure. Methods of tailoring ballistic characteristics of propellant burn to result in desired operational pressure pulse characteristics are also disclosed.

23 Claims, 3 Drawing Sheets

(56) References Cited

U.S. PATENT DOCUMENTS

| | | | | |
|---|---|---|---|---|
| 5,230,287 | A | 7/1993 | Arrell et al. | |
| 5,431,101 | A | 7/1995 | Arrell et al. | |
| 5,626,360 | A * | 5/1997 | Lauritzen et al. | 280/741 |
| 6,082,450 | A | 7/2000 | Snider et al. | |
| 6,263,283 | B1 | 7/2001 | Snider et al. | |
| 6,817,298 | B1 | 11/2004 | Zharkov et al. | |
| 7,073,589 | B2 | 7/2006 | Tiernan et al. | |
| 7,097,203 | B2 | 8/2006 | Burns et al. | |
| 7,353,866 | B2 | 4/2008 | Snider et al. | |
| 7,431,075 | B2 | 10/2008 | Brooks et al. | |
| 7,487,827 | B2 | 2/2009 | Tiernan | |
| 7,565,930 | B2 | 7/2009 | Seekford | |
| 7,789,153 | B2 | 9/2010 | Prinz et al. | |
| 7,810,569 | B2 | 10/2010 | Hill et al. | |
| 7,861,785 | B2 | 1/2011 | Frazier et al. | |
| 7,909,096 | B2 | 3/2011 | Clark et al. | |
| 7,950,457 | B2 | 5/2011 | Seekford | |
| 8,033,333 | B2 | 10/2011 | Frazier et al. | |
| 8,186,425 | B2 | 5/2012 | Smart et al. | |
| 8,186,435 | B2 | 5/2012 | Seekford | |
| 2003/0155112 | A1 | 8/2003 | Tiernan et al. | |
| 2005/0109509 | A1 | 5/2005 | Snider et al. | |
| 2006/0048664 | A1 | 3/2006 | Tiernan et al. | |
| 2014/0238678 | A1 | 8/2014 | Arrell et al. | |

OTHER PUBLICATIONS

Schatz, John, "PulsFrac™ Summary Technical Description," 2003, John F. Schatz Research & Consulting, Inc., Del Mar, CA, pp. 1-8.

International Search Report, ISA/KR, International Application No. PCT/US2014/017064, Jun. 23, 2014, three (3) pages.

Written Opinion of the International Searching Authority, ISA/KR, International Application No. PCT/US2014/017064, Jun. 23, 2014, 12 pages.

* cited by examiner

METHOD AND APPARATUS FOR BALLISTIC TAILORING OF PROPELLANT STRUCTURES AND OPERATION THEREOF FOR DOWNHOLE STIMULATION

TECHNICAL FIELD

Embodiments of the present disclosure relate to the use of propellants for downhole application. More particularly, embodiments of the present disclosure relate to methods and apparatus for ballistic tailoring of propellant structures for stimulation of producing formations intersected by a wellbore, and operation of such propellant structures.

BACKGROUND

Current state of the art propellant-based downhole stimulation employs only one ballistic option, in the form of a right circular cylinder of a single type of propellant grain, which may comprise a single volume or a plurality of propellant "sticks" in a housing and typically having an axially extending hole through the center of the propellant through which a detonation cord extends, although it has been known to wrap the detonation cord helically around the propellant grain. When deployed in a wellbore adjacent a producing formation, the detonation cord is initiated and gases from the burning propellant grain exit the housing at select locations, entering the producing formation. The pressurized gas may be employed to fracture a formation, to perforate the formation when spatially directed through apertures in the housing against the wellbore wall, or to clean existing fractures or perforations made by other techniques, in any of the foregoing cases increasing the effective surface area of producing formation material available for production of hydrocarbons. In conventional propellant-based stimulation, due to the use of a single, homogeneous propellant and centralized propellant initiation, only a single ballistic trace in the form of a gas pressure pulse from propellant burn may be produced.

U.S. Pat. Nos. 7,565,930, 7,950,457 and 8,186,435 to Seekford, the disclosure of each of which is incorporated herein in its entirety by this reference, propose a technique to alter an initial surface area for propellant burning, but this technique cannot provide a full regime of potentially available ballistics for propellant-induced stimulation in a downhole environment. It would be desirable to provide enhanced control of not only the initial surface area (which alters the initial rise rate of the gas pulse, or dP/dt, responsive to propellant ignition), but also the duration and shape of the remainder of the pressure pulse introduced by the burning propellant.

BRIEF SUMMARY

In some embodiments, the present disclosure comprises a downhole stimulation tool comprising a housing and a propellant structure within the housing, the propellant structure comprising at least one propellant grain of a formulation, at least another propellant grain of a formulation different from the formulation of the at least one propellant grain adjacent the at least one propellant grain, and at least one initiation element proximate at least one of the propellant grains.

In other embodiments, the present disclosure comprises a downhole stimulation tool comprising a housing and a propellant structure within the housing, the propellant structure comprising at least one propellant grain having a longitudinal bore extending therethrough laterally offset from a center of the propellant grain, and at least one initiation element within the longitudinal bore.

In further embodiments, the present disclosure comprises a method of operating a downhole stimulation tool, the method comprising initiating a propellant grain of a formulation from a longitudinally extending location within the propellant grain to burn the propellant grain in a radially extending direction, and initiating another propellant grain of a different formulation comprising a sleeve surrounding the propellant grain along at least a portion of a boundary between the propellant grain and the another propellant grain.

In yet other embodiments, the present disclosure comprises a method of operating a downhole stimulation tool, the method comprising initiating a propellant grain of a formulation from a longitudinally extending location laterally offset from a center of the propellant grain within the propellant grain to burn the propellant grain in a laterally extending direction.

In still further embodiments, the present disclosure comprises a method of operating a downhole stimulation tool, the method comprising initiating at least one propellant grain to produce a ballistic trace selected from the group consisting of a boost-sustain trace and a sustain-boost trace.

In yet further embodiments, the present disclosure comprises a propellant structure comprising at least one propellant grain of a formulation and at least another propellant grain of a formulation different from the formulation of the at least one propellant grain adjacent the at least one propellant grain.

In some other embodiments, the present disclosure comprises a propellant structure comprising at least one propellant grain having a longitudinal bore extending therethrough laterally offset from a center of the at least one propellant grain.

DETAILED DESCRIPTION

The illustrations presented herein are not actual views of any particular stimulation tool or propellant structure suitable for use with a stimulation tool, but are merely idealized representations that are employed to describe embodiments of the present disclosure.

In some embodiments, the present disclosure comprises propellant structures comprising two or more regions of differing propellants, staged in a way to provide an appropriate ballistic trace for a pressure pulse into a downhole environment.

In one embodiment, a propellant structure comprises a volume of one type of propellant surrounded by at least one additional sleeve of different propellant arranged concentrically or eccentrically around a center of the propellant structure.

In another embodiment, a propellant structure comprises at least one longitudinally extending hole for an initiation element located laterally offset from the center of a volume of propellant to provide a flexible tailoring of the burn of the propellant.

In further embodiments, a propellant structure comprises initiation elements located at one or both ends of a volume of propellant and in some embodiments, a longitudinally extending initiation element within part or all of a longitudinal extent of the propellant volume.

In still further embodiments, multiple different propellants, concentrically or eccentrically arranged, may be employed in conjunction with laterally offset initiation element paths to provide substantially infinite capability to tailor the ballistics of the pressure pulse that is created by propellant burn to apply desired forces to a producing formation in the downhole environment.

In other embodiments, various combinations of single and multiple propellants in a propellant structure may be employed in conjunction with different initiation element locations and configurations.

In yet other embodiments, a longitudinal bore through a propellant structure and having an initiation element therein may be configured with a non-circular transverse cross-section such as, for example, a polygonal cross-section.

In still other embodiments, a central propellant grain may have a non-cylindrical transverse cross-section such as, for example, a polygonal cross-section, and be surrounded by sleeves of one or more other propellant grains of mutually differing compositions.

Figure 1:
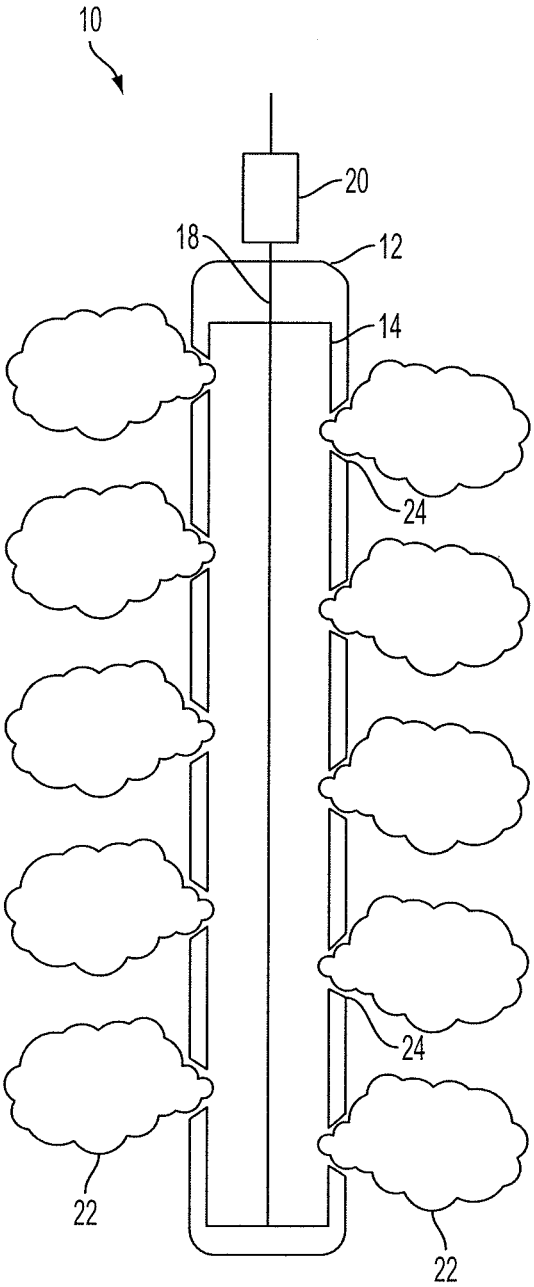
FIG. 1 is a schematic of a propellant-based stimulation tool suitable for use in implementing embodiments of the present disclosure.

Referring to FIG. 1, a stimulation tool 10 for use in stimulating a producing formation in a wellbore is shown. As used herein, "producing formation" means and includes without limitation any target subterranean formation having the potential for producing hydrocarbons in the form of oil, natural gas, or both, as well as any subterranean formation suitable for use in geothermal heating, cooling and power generation. Stimulation tool 10 may be deployed in a wellbore adjacent one or more producing formations by conventional techniques, including without limitation wireline, tubing and coiled tubing.

Stimulation tool 10 comprises an outer housing 12, within which is located a propellant grain 14, conventionally in the form of a right circular cylinder, although the disclosure is not so limited, and propellant grains of other transverse cross-sections may be employed. An initiation bore 16 (see FIG. 2A) extends axially through propellant grain 14, and may comprise a tube within the initiation bore 16. An initiation element 18, which may comprise a detonation cord, detonator, initiator or other suitable propellant initiation element, is employed to initiate burn of propellant grain 14. Depending upon the selected initiation element, an initiator 20 of conventional design, for example, a shaped charge, may be located at one end of initiation element 18 and used to initiate the initiation element 18. If initiation element 18 is a detonator cord, initiator 20 may be a detonator. If initiation element 18 is itself an initiator, then a separate initiator 20 may be eliminated, or initiator 20 may be a firing unit. Components for propellant initiation are well known to those of ordinary skill in the art and, so, are not further described herein. In use and when stimulation tool 10 is deployed in a wellbore adjacent a producing formation, when initiator 20 is triggered to initiate initiation element 18, initiation element 18 initiates burn of propellant grain 14, generating combustion products in the form of high pressure gases 22 that exit housing 12 through apertures 24 in the wall of housing 12 and are employed to stimulate the subterranean formation adjacent to stimulation tool 10. The general design, structure and components of a stimulation tool 10, other than the propellant structure of embodiments of the present disclosure, may be substantially conventional and comprise a number of different configurations and, so, will not be further described. As used herein, the term "propellant structure" means and includes the type, configuration and volume of one or more propellant grains, the type and location of one or more initiation elements and initiators and any associated components for timing of propellant grain initiation, delay of propellant grain initiation, or combinations of any of the foregoing.

Formation stimulation may take the form, as noted previously, of fracturing the target rock formation. In embodiments of the present disclosure, propellant type, amount and burn rate may be adjusted to accommodate different geological conditions and provide different pressures and different pressure rise rates for maximum benefit. It is contemplated that fracturing may be effected uniformly (e.g., 360° about a wellbore axis), or directionally, such as for example, in a 45° arc, a 90° arc, etc., transverse to the axis of the wellbore. Fracture extension may be controlled to a distance, by way of non-limiting example, from about ten to about one hundred feet from the wellbore. Embodiments of the disclosure are contemplated for use in restimulation of existing wells, in conjunction with hydraulic fracturing to reduce formation breakdown pressures, and as a substitute for conventional hydraulic fracturing.

Figure 2A:
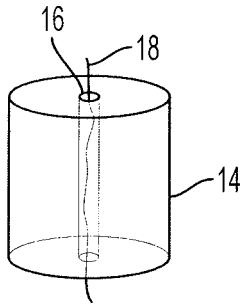
FIG. 2A is a perspective schematic of a conventional propellant structure and configuration.
Figure 2B:
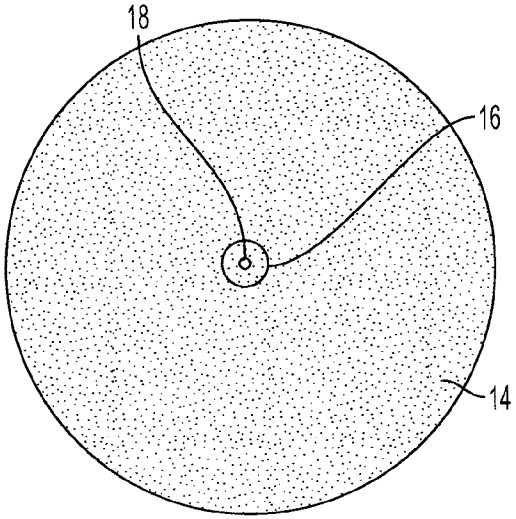
FIG. 2B is a top elevation schematic of the conventional propellant structure configuration of FIG. 2A.

Referring to FIGS. 2A and 2B, in a conventional simulation tool, the propellant structure comprises a propellant grain 14 configured as a right circular cylinder of a single composition and grain structure, and includes an initiation bore 16 extending axially through the center thereof. Thus, burn of propellant grain 14 is initiated at the center thereof, and proceeds radially outward as the propellant grain is consumed at a substantially constant burn rate, as is known by those of ordinary skill in the art.

Figure 3:
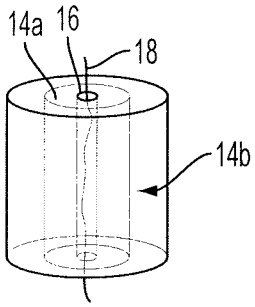
FIG. 3 is a perspective schematic of an embodiment of a propellant structure according to the present disclosure.

Referring to FIG. 3, in one embodiment of the present disclosure a composite propellant structure comprises at least two regions of propellant grain 14*a* and 14*b*, which regions differ in composition and which exhibit different burn rates. As depicted, propellant grain 14*a* is of cylindrical configuration, while propellant grain 14*b* comprises a tubular, cylindrical sleeve encompassing propellant grain 14*a*. In FIG. 3, initiation bore 16 extends axially through the center of the composite propellant structure which may be, but need not be, structured as a right circular cylinder.

Figure 4:
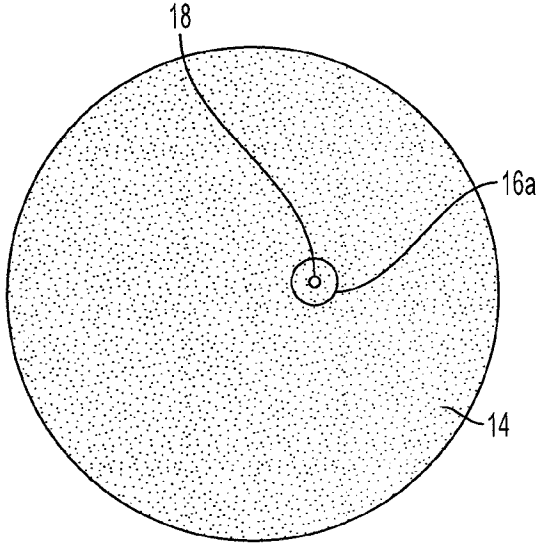
FIG. 4 is a top elevation schematic of another embodiment of a propellant structure according to the present disclosure.

Referring to FIG. 4, in another embodiment of the present disclosure a propellant structure comprises a propellant grain 14 which may, but need not be, configured as a right circular cylinder and includes an axially extending initiation bore 16*a*, which is laterally offset from the center of propellant grain 14.

Figure 5:
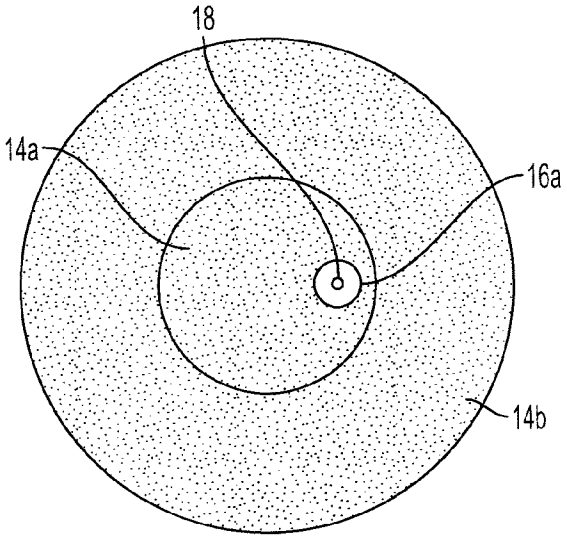
FIG. 5 is a top elevation schematic of a further embodiment of a propellant structure according to the present disclosure.

Referring to FIG. 5, in a further embodiment of the present disclosure a composite propellant structure comprises at least two regions of propellant grain 14*a* and 14*b* which may, but need not be, configured as a right circular cylinder. As depicted, propellant grain 14*a* is of cylindrical configuration, while propellant grain 14*b* comprises a tubular, cylindrical sleeve encompassing propellant grain 14*a*. An axially extending initiation bore 16*a* is laterally offset from the center of propellant grain 14*a* and, thus, from the center of the composite propellant structure.

Figure 6:
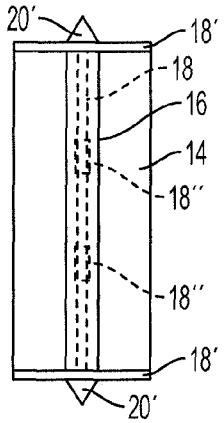
FIG. 6 is a schematic of yet another embodiment of a propellant structure according to the present disclosure.

Referring to FIG. 6, it is also contemplated that propellant burn may be initiated from ends of the propellant grain 14 by initiators 20' and initiation elements 18' in lieu of, or in addition to the use of a longitudinally extending initiation element 18 as shown in broken lines or other initiation element or elements 18" as shown in broken lines and disposed in initiation bore 16.

Figure 7:
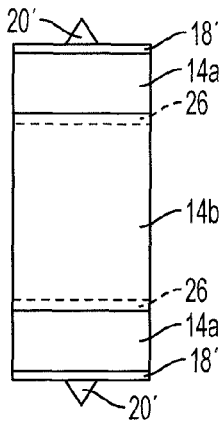
FIG. 7 is a schematic of a still further embodiment of a propellant structure according to the present disclosure.

Referring to FIG. 7, it is further contemplated that a composite propellant structure may be longitudinally segmented rather than laterally segmented, and burn of the propellant initiated by initiation elements 18' from one or both ends of the propellant structure, with regions of a first propellant grain 14*a* adjacent both ends of the propellant structure, and a second, different propellant grain 14*b* located between the two regions of first propellant grain 14*a*. Optionally, a consumable thermal barrier 26, as shown in broken lines, may be placed between the differing propellant grains 14*a*, 14*b* to provide a pause and consequent pressure reduction between burn of the two different types of propellant grains, if such a pressure pulse sequence and ballistic trace is desirable.

In addition to the embodiments depicted herein, it is contemplated that propellant structures employing multiple different propellant grains of more than two compositions may be employed, and that more than one volume of a particular propellant grain type may be employed at different locations in a propellant structure. Further, the two or more different propellant grains of a composite grain structure, as well as two or more volumes of a particular propellant grain type need not comprise a right circular cylinder and a surrounding cylindrical (e.g., tubular) sleeve. For example, an inner propellant grain may comprise a polygonal (e.g., square, rectangular, hexagonal, cross-shaped, star-shaped, elliptical transverse cross-section as respectively depicted in FIGS. 9A through 9F, or other suitable transverse cross-section, to vary time of burn of different portions (e.g., surfaces) of the inner propellant grain as initiated from a central, longitudinally extending location before burn of a surface of an adjacent portion of another, adjacently located propellant grain is initiated. Similarly, a longitudinal bore in which an initiation element is disposed may comprise a cross-section other than cylindrical and of a shape as depicted in any one of FIGS. 9A through 9F with respect to the cross-sections of the depicted inner propellant grains. Such an approach may be used to enhance the burn surface of a propellant grain, and to cause selective initiation of burn in portions of a second propellant grain surrounding the propellant grain having the bore therein. In another approach to selective initiation of propellant grain surfaces, use of a longitudinally scored tube containing an initiation element as described in the aforementioned, incorporated by reference U.S. Patents 7,565,930, 7,950,457 and 8,186,435 to Seekford may be employed to selectively direct energy from the initiation element to portions of the surrounding propellant grain. In either case, the overall pressure pulse signature resulting from burn of the respective, different propellants may be tailored for a desired effect. As noted above, a laterally offset initiation bore 16 and initiation element 18 may be employed in conjunction with a composite propellant structure.

A propellant of the propellant grain 14, 14*a*, 14*b*, etc., suitable for implementation of embodiments of the present disclosure may include, without limitation, a material used as a solid rocket motor propellant. Various examples of such propellants and components thereof are described in Thakre et al., Solid Propellants, Rocket Propulsion, Volume 2, Encyclopedia of Aerospace Engineering, John Wiley & Sons, Ltd. 2010, the disclosure of which document is incorporated herein in its entirety by reference. The propellant may be a class 4.1, 1.4 or 1.3 material, as defined by the United States Department of Transportation shipping classification, so that transportation restrictions are minimized. By way of example, the propellant may include a polymer having at least one of a fuel and an oxidizer incorporated therein. The polymer may be an energetic polymer or a non-energetic polymer, such as glycidyl nitrate (GLYN), nitratomethylmethyloxetane (NMMO), glycidyl azide (GAP), diethyleneglycol triethyleneglycol nitraminodiacetic acid terpolymer (9DT-NIDA), bis(azidomethyl)-oxetane (BAMO), azidomethylmethyl-oxetane (AMMO), nitraminomethyl methyloxetane (NAMMO), bis(difluoroaminomethyl)oxetane (BFMO), difluoroaminomethylmethyloxetane (DFMO), copolymers thereof, cellulose acetate, cellulose acetate butyrate (CAB), nitrocellulose, polyamide (nylon), polyester, polyethylene, polypropylene, polystyrene, polycarbonate, a polyacrylate, a wax, a hydroxyl-terminated polybutadiene (HTPB),), a hydroxyl-terminated poly-ether (HTPE), carboxyl-terminated polybutadiene (CTPB) and carboxyl-terminated polyether (CTPE), diaminoazoxy furazan (DAAF), 2,6-bis(picrylamino)-3,5-dinitropyridine (PYX), a polybutadiene acrylonitrile/acrylic acid copolymer binder (PBAN), polyvinyl chloride (PVC), ethylmethacrylate, acrylonitrile-butadiene-styrene (ABS), a fluoropolymer, polyvinyl alcohol (PVA), or combinations thereof. The polymer may function as a binder, within which the at least one of the fuel and oxidizer is dispersed. In one embodiment, the polymer is polyvinyl chloride.

The fuel may be a metal, such as aluminum, nickel, magnesium, silicon, boron, beryllium, zirconium, hafnium, zinc, tungsten, molybdenum, copper, or titanium, or alloys, mixtures or compounds thereof, such as aluminum hydride ($AlH_3$), magnesium hydride ($MgH_2$), or borane compounds ($BH_3$). The metal may be used in powder form. In one embodiment, the metal is aluminum. The oxidizer may be an inorganic perchlorate, such as ammonium perchlorate or potassium perchlorate, or an inorganic nitrate, such as ammonium nitrate or potassium nitrate. Other oxidizers may also be used, such as hydroxylammonium nitrate (HAN), ammonium dinitramide (ADN), hydrazinium nitroformate, a nitramine, such as cyclotetramethylene tetranitramine (HMX), cyclotrimethylene trinitramine (RDX), 2,4,6,8,10,12-hexanitro-2,4,6,8,10,12-hexaazaisowurtzitane (CL-20 or HNIW), and/or 4,10-dinitro-2,6,8,12-tetraoxa-4,10-diazatetracyclo-[5.5.0.0$^{5,9}$.0$^{3,11}$]-dodecane (TEX). In one embodiment, the oxidizer is ammonium perchlorate. The propellant may include additional components, such as at least one of a plasticizer, a bonding agent, a burn rate modifier, a ballistic modifier, a cure catalyst, an antioxidant, and a pot life extender, depending on the desired properties of the propellant. These additional components are well known in the rocket motor art and, therefore, are not described in detail herein. The components of the propellant may be combined by conventional techniques, which are not described in detail herein.

Propellants for implementation of embodiments of the present disclosure may be selected to exhibit, for example, burn rates from about 0.1 in/sec to about 4.0 in/sec at 1,000 psi and an ambient temperature of about 70° F. Burn rates will vary, as known to those of ordinary skill in the art, with variance from the above pressure and temperature conditions before and during propellant burn.

If the propellant grain 14 includes a single propellant formulation, the propellant grain 14 may be cast, extruded or machined from the propellant formulation. Casting, extrusion and machining of propellant formulations are each well known in the art and, therefore, are not described in detail herein. If two or more propellants are used in the propellant grain 14, each propellant formulation may be produced by conventional techniques and then arranged into a desired configuration. If two or more different propellants are used to form, for example, first and second propellant grains 14*a* and 14*b* of a composite propellant structure, each propellant may be a homogeneous composition. For instance, each of a first propellant and a second propellant may be produced in a stick configuration and the second propellant arranged concentrically around the first propellant. Alternatively, the first propellant may be extruded and the second propellant cast around the first propellant.

The formulation of the propellant(s) may be selected based on a desired ballistic trace upon initiation, which is determined by the target geologic strata within which the stimulation tool 10 is to be used. The propellant grain 14 may include a single propellant that is formulated to produce a desired ballistic trace upon ignition. Alternatively, the propellant grain 14 may include two or more propellants that produce the desired ballistic trace upon ignition. The propellant grain 14 may be configured, and initiated at a selected location adjacent one or more surfaces thereof to produce a progressive burn, neutral burn, or regressive burn upon ignition. A progressive burn occurs when the reacting surface area of a burning propellant grain increases over time as, for example, when a cylindrical propellant volume employs a cylindrical central bore from which a burn is initiated. As the propellant burns radially outward and transverse to the bore, the surface area of the burn increases. A neutral burn occurs when the reacting surface area of a propellant grain remains substantially constant over time as, for example, a propellant volume of substantially constant lateral extent (e.g., diameter) is initiated from an end. A regressive burn occurs when the reacting surface area of a propellant grain decreases over time as, for example, if a cone-shaped propellant grain is initiated across its base.

Figure 8A:
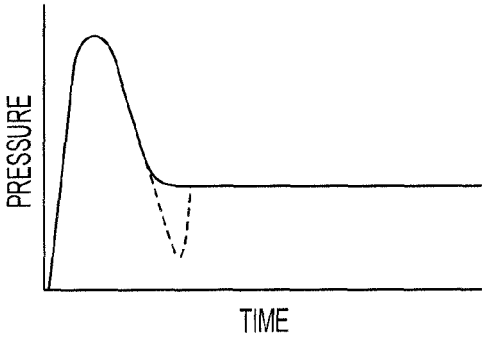
FIG. 8A is a schematic graphic depiction of a boost-sustain ballistic trace in terms of pressure versus elapsed time.
Figure 8B:
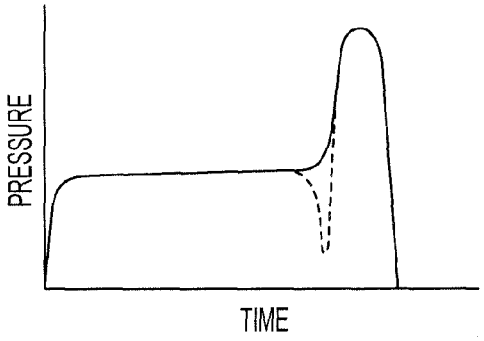
FIG. 8B is a schematic graphic depiction of a sustain-boost ballistic trace in terms of pressure versus elapsed time.
Figure 9A:
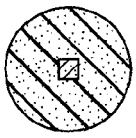
FIGS. 9A through 9F are schematic transverse cross-sections of cylindrical propellant grains illustrating bores of different cross-sections.
Figure 9B:
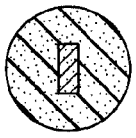
Figure 9C:
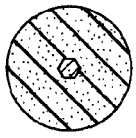
Figure 9D:
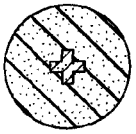
Figure 9E:
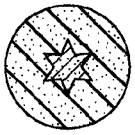
Figure 9F:
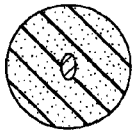

In one example of a tailored, non-uniform ballistic trace that may be termed "boost-sustain" and illustrated graphically in FIG. 8A, a high pressure level may be generated initially, followed by a drop to a lower, substantially constant pressure for the remainder of a propellant burn. Such a burn may be exhibited, for example, by a propellant structure as illustrated in FIG. 3, wherein propellant grain 14*a* exhibits a substantially higher burn rate than surrounding propellant grain 14*b*, the burn rate of propellant grain 14*a* being sufficiently higher than that of propellant grain 14*b* to offset the greater reaction surface area exposed as propellant grain 14*b* commences burn. In another example of a tailored, non-uniform ballistic trace that may be termed "sustain-boost" and is illustrated graphically in FIG. 8B, an initial pressure level is generated followed by a rapid increase to a substantially higher pressure level. Such a burn may also be exhibited, for example, by a propellant structure as illustrated in FIG. 3, wherein propellant grain 14*a* exhibits a substantially lower burn rate than surrounding propellant grain 14*b*, the burn rate of propellant grain 14*a* being sufficiently lower than that of propellant grain 14*b*, which burn rate may not need to be remarkably greater than that of propellant grain 14*a* due to the greater reaction surface area exposed as propellant grain 14*b* commences burn. Of course, if a consumable thermal barrier 26, as shown in broken lines in FIG. 7, is placed between propellant grain or grains 14*a* and propellant grain 14*b*, a pressure drop may be implemented as depicted in broken lines in each of FIGS. 8A and 8B.

A boost-sustain ballistic trace or sustain-boost ballistic trace may be useful in a downhole stimulation operation to, for example, fracture a producing formation adjacent a stimulation tool 10 employing an initial, relatively higher pressure and then extend and maintain the fractures in the producing formation in an open state for a sufficient time for the rock to relax and maintain the fractures in an open state. A boost-sustain ballistic trace may be useful in a downhole stimulation operation to, for example, prestress a formation to be fractured by pressurizing the wellbore annulus adjacent a stimulation tool 10 to a magnitude substantially equal to a compressive strength of the formation rock and then raising the pressure to effect fracture of the producing formation.

The propellant grain 14 may, optionally, include a coating to prevent leaching of the propellant into the downhole environment during use and operation. The coating may include a fluoroelastomer, mica, and graphite, as described in the aforementioned, incorporated by reference U.S. Pat. Nos. 7,565,930, 7,950,457 and 8,186,435 to Seekford.

The disclosed propellant structures and combinations thereof as well as the disclosed offset placement of a initiation element, each alone or in combination with one another, may be used to provide virtually infinite flexibility to tailor a rise time, duration and magnitude of a pressure pulse, and time-sequenced portions thereof from propellant burn within the downhole environment to match the particular requirements for at least one of fracturing, perforating, and cleaning of the target geologic strata in the form of a producing formation for maximum efficacy. Propellant burn rates and associated characteristics (i.e., pressure pulse rise time, burn temperature, etc.) of known propellants and composite propellant structures, for example and without limitation, propellant structures comprising propellants employed in solid rocket motors for propulsion of aerospace vehicles and as identified above, in addition to conventional propellants employed in the oil service industry, may be mathematically modeled in conjunction with an initial burn initiation location to optimize magnitude and timing of gas pressure pulses from propellant burn.

Mathematical modeling may be based upon ballistics codes for solid rocket motors but adapted for physics (i.e., pressure and temperature conditions) experienced downhole, as well as for the presence of multiple apertures for gas from combusting propellant to exit a housing. The ballistics codes may be extrapolated with a substantially time-driven burn rate. Of course, the codes may be further refined over time by correlation to multiple iterations of empirical data obtained in physical testing under simulated downhole environments and actual downhole operations. Such modeling has been conducted with regard to conventional downhole propellants in academia and industry as employed in conventional configurations. An example of software for such modeling include PULSFRAC® software developed by John F. Schatz Research & Consulting, Inc. of Del Mar, Calif., and now owned by Baker Hughes Incorporated of Houston, Tex. and licensed to others in the oil service industry. However, the ability to tailor propellant burn characteristics as enabled by embodiments of the present disclosure and ballistic trace signatures has not been recognized or implemented in the state of the relevant art.

Embodiments of the present disclosure employing propellants provide significant advantages over the use of hydraulic or explosive energy in fracturing. For example, conventional explosives may generate excessive pressure in an uncontrolled manner in a brief period of time (i.e., 1,000,000 psi in 1 microsecond), while hydraulic fracturing may generate much lower pressures over an excessively long period of time (i.e., 5,000 psi in one hour). Propellant-base stimulation tools according to embodiments of the present disclosure may be used to generate relatively high pressures over a relatively short time interval, for example, 20,000 psi in ten milliseconds, and in the form of a controlled ballistic trace. In addition, use of embodiments of the present disclosure reduces if not eliminates the water requirements of hydraulic fracturing, reduces or eliminates disposal issues of chemicals-laden fracturing fluid, provides a fifty percent cost reduction versus hydraulic fracturing with minimal on-site equipment and personnel requirements (e.g., no pumps, intensifiers, manifolds, etc., and attendant operating personnel), and significantly reduces service time required to get a well on line and producing.

Additionally, the need for chemicals employed in hydraulic fracturing is eliminated, and multiple controlled radial fractures at desired locations may be made surrounding a wellbore, greatly reducing the potential for aquifer contamination. Further, injection and withdrawal rates in gas storage wells may be enhanced, wellbore damage from perforating may be reduced to lower formation breakdown pressure in some instances, acidizing effectiveness may be enhanced, producing zones may be stimulated without the need to set packers and bridge plugs, and formation damage from incompatible fluids, as well as vertical growth of fractures out of a pay zone may be minimized.

While particular embodiments of the invention have been shown and described, numerous variations and alternative embodiments encompassed by the present disclosure will occur to those skilled in the art. Accordingly, the invention is only limited in scope by the appended claims and their legal equivalents.

What is claimed is:

1. A downhole stimulation tool, comprising:

a housing; and a propellant structure within the housing and comprising:

at least one propellant grain of a formulation;

a single longitudinal bore extending through the at least one propellant grain;

at least another propellant grain of a formulation different from the formulation of the at least one propellant grain adjacent the at least one propellant grain; and at least one initiation element for initiating the at least one propellant grain, the at least one initiation element disposed in the single longitudinal bore.

2. The downhole stimulation tool of claim 1, wherein the at least another propellant grain comprises a sleeve surrounding the at least one propellant grain.

3. The downhole stimulation tool of claim 2, wherein the at least another propellant grain comprises at least two other propellant grains, at least one of the at least two other propellant grains of a formulation different from the formulation of at least one of the at least one propellant grain and at least another of the at least two other propellant grains, each of the at least two other propellant grains comprising a tubular sleeve.

4. The downhole stimulation tool of claim 2, wherein the at least one propellant grain is of one of substantially cylindrical transverse cross-section and polygonal transverse cross-section.

5. The downhole stimulation tool of claim 1, wherein the at least one initiation element extends substantially through the longitudinal bore.

6. The downhole stimulation tool of claim 5, wherein the single longitudinal bore is laterally offset from a center of the at least one propellant grain.

7. The downhole stimulation tool of claim 5, wherein the single longitudinal bore comprises one of a circular transverse cross-section and a non-circular transverse cross-section.

8. The downhole stimulation tool of claim 5, wherein the single longitudinal bore comprises a polygonal transverse cross-section.

9. The downhole stimulation tool of claim 1, wherein the at least one initiation element comprises initiation elements proximate opposing ends of the single longitudinal bore.

10. The downhole stimulation tool of claim 9, further comprising at least one other initiation element disposed within the single longitudinal bore.

11. The downhole stimulation tool of claim 10, wherein the at least one other initiation element extends substantially through the single longitudinal bore.

12. The downhole stimulation tool of claim 1, each of the at least one propellant grain and the at least another propellant grain comprising:

a polymer selected from the group consisting of polyvinyl chloride, glycidyl nitrate (GLYN), nitratomethylmethyloxetane (NMMO), glycidyl azide (GAP), diethyleneglycol triethyleneglycol nitraminodiacetic acid terpolymer (9DT-NIDA), bis(azidomethyl)-oxetane (BAMO), azidomethylmethyl-oxetane (AMMO), nitraminomethyl methyloxetane (NAMMO), bis(difluoroaminomethyl)oxetane (BFMO), difluoroaminomethylmethyloxetane (DFMO), copolymers thereof, cellulose acetate, cellulose acetate butyrate (CAB), nitrocellulose, polyamide (nylon), polyester, polyethylene, polypropylene, polystyrene, polycarbonate, a polyacrylate, a wax, a hydroxyl-terminated polybutadiene (HTPB), a hydroxyl-terminated poly-ether (HTPE), carboxyl-terminated polybutadiene (CTPB) and carboxyl-terminated polyether (CTPE), diaminoazoxy furazan (DAAF), 2,6-bis(picrylamino)-3,5-dinitropyridine (PYX), a polybutadiene acrylonitrile/acrylic acid copolymer binder (PBAN), polyvinyl chloride (PVC), ethylmethacrylate, acrylonitrile-butadiene-styrene (ABS), a fluoropolymer, polyvinyl alcohol (PVA), or combinations thereof;

a fuel selected from the group consisting of aluminum, nickel, magnesium, silicon, boron, beryllium, zirconium, hafnium, zinc, tungsten, molybdenum, copper, or titanium, or alloys mixtures or compounds thereof, such as aluminum hydride ($AlH_3$), magnesium hydride ($MgH_2$), or borane compounds ($BH_3$); and an oxidizer selected from the group consisting of ammonium perchlorate, potassium perchlorate, ammonium nitrate, potassium nitrate, hydroxylammonium nitrate (HAN), ammonium dinitramide (ADN), hydrazinium nitroformate, cyclotetramethylene tetranitramine (HMX), cyclotrimethylene trinitramine (RDX), 2,4,6,8,10,12-hexanitro-2,4,6,8,10,12-hexaazaisowurtzitane (CL-20 or HNIW), and 4,10-dinitro-2,6,8,12-tetraoxa-4,10-diazatetracyclo-[5.5.0.0 $^{5,9}$.0 $^{3,11}$]-dodecane (TEX).

13. A downhole stimulation tool, comprising:

a housing; and a propellant structure within the housing and comprising:

at least one propellant grain of one of substantially cylindrical transverse cross-section and polygonal transverse cross-section having a single longitudinal bore extending therethrough laterally offset from a center of the at least one propellant grain; and one or more additional propellant grains, each additional propellant grain configured as a sleeve and surrounding another propellant grain, at least one of the additional propellant grains of a formulation different from a formulation of the at least one substantially cylindrical propellant grain; and at least one initiation element for initiating the at least one propellant grain within the longitudinal bore.

14. The downhole stimulation tool of claim 13, wherein the at least one initiation element extends substantially through the longitudinal bore.

15. The downhole stimulation tool of claim 13, wherein the longitudinal bore comprises one of a circular transverse cross-section and a non-circular transverse cross-section.

16. The downhole stimulation tool of claim 13, wherein the longitudinal bore comprises a polygonal transverse cross-section.

17. The downhole stimulation tool of claim 13, wherein the at least one initiation element further comprises initiation elements proximate opposing ends of the single longitudinal bore.

18. A method of operating a downhole stimulation tool, the method comprising:

initiating a substantially cylindrical propellant grain of a formulation from a single longitudinally extending location within the propellant grain to burn the propellant grain in a radially extending direction; and initiating another propellant grain of a different formulation comprising a tubular, substantially cylindrical sleeve surrounding a substantially cylindrical exterior surface of the propellant grain along at least a portion of a boundary between the propellant grain and the another propellant grain.

19. The method of claim 18, wherein initiating the substantially cylindrical propellant grain from a single longitudinally extending location within the propellant grain comprises initiating the substantially cylindrical propellant grain from a single longitudinally extending location offset from a center of the substantially cylindrical propellant grain.

20. The method of claim 18, further comprising initiating the substantially cylindrical propellant grain from a bore thereof of circular transverse cross-section.

21. The method of claim 18, further comprising initiating the substantially cylindrical propellant grain from a bore thereof of non-circular transverse cross-section.

22. The method of claim 21, further comprising initiating the substantially cylindrical propellant grain from a bore thereof of polygonal cross-section.

23. A method of operating a downhole stimulation tool, the method comprising initiating a substantially cylindrical propellant structure from a single longitudinally extending location laterally offset from a center of the propellant structure within the propellant structure to burn the propellant structure in a laterally extending direction, the propellant structure comprising at least one propellant grain of a formulation and at least another propellant grain of a formulation different from the formulation of the at least one propellant grain adjacent the at least one propellant grain.

* * * * *